US009233780B2

(12) United States Patent
Cameron et al.

(10) Patent No.: US 9,233,780 B2
(45) Date of Patent: Jan. 12, 2016

(54) PACKAGE OF WET WIPES WITH EASY OPENABILITY, IMPROVED MOISTURE RETENTION AND MANUFACTURING EFFICIENCY

(71) Applicant: The Procter & Gamble Company, Cincinnati, OH (US)

(72) Inventors: Christopher Scott Cameron, Cincinnati, OH (US); Daniel Scott Ebert, Burlington, KY (US); Melissa Renee Hickman, Alexandrai, KY (US); Angela Pauly, Madeira, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/664,072

(22) Filed: Mar. 20, 2015

(65) Prior Publication Data

US 2015/0266633 A1 Sep. 24, 2015

Related U.S. Application Data

(60) Provisional application No. 61/955,980, filed on Mar. 20, 2014.

(51) Int. Cl.

| | |
|---|---|
| ***B65D 81/24*** | (2006.01) |
| ***B65D 43/16*** | (2006.01) |
| ***A47K 10/42*** | (2006.01) |
| ***B65D 53/02*** | (2006.01) |
| ***B65D 75/26*** | (2006.01) |
| ***B65D 81/22*** | (2006.01) |
| ***B65B 11/48*** | (2006.01) |
| ***B65B 61/02*** | (2006.01) |
| ***B65B 51/02*** | (2006.01) |
| ***B65B 63/00*** | (2006.01) |
| *A47K 10/32* | (2006.01) |

(52) U.S. Cl.

CPC ..... *B65D 43/16* (2013.01); *A47K 10/421* (2013.01); *B65B 11/48* (2013.01); *B65B 51/02* (2013.01); *B65B 61/02* (2013.01); *B65B 63/00* (2013.01); *B65D 53/02* (2013.01); *B65D 75/26* (2013.01); *B65D 81/22* (2013.01); *A47K 2010/3233* (2013.01); *A47K 2010/3266* (2013.01); *B65D 2543/00435* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,790,744 A | | 2/1974 | Bowen | |
| 4,192,420 A | * | 3/1980 | Worrell, Sr. | B65D 81/22 206/205 |
| 4,220,244 A | * | 9/1980 | Elmore | A45D 37/00 206/210 |

(Continued)

OTHER PUBLICATIONS

Laser Sharp Flex Pak Services—Laser Vs. Mechanical Processing (http://flexpakservices.com/why-lasers.htm) Sep. 30, 2010 (1 page).

(Continued)

*Primary Examiner* — Jacob K Ackun
(74) *Attorney, Agent, or Firm* — William E. Gallagher

(57) ABSTRACT

A package containing a stack of wet wipes moistened with aqueous lotion is disclosed. The package comprises a polymeric film wrap, the film wrap comprising a laminate with an inner layer of a first polymer and an outer layer of a second polymer, and a surface bearing scoring along a path defining a substantially closed shape, the scoring at least partially penetrating the outer layer and not entirely penetrating the inner layer.

7 Claims, 4 Drawing Sheets

(56) References Cited

U.S. PATENT DOCUMENTS

| | | | | |
|---|---|---|---|---|
| 5,328,053 | A | 7/1994 | Cook et al. | |
| 5,938,013 | A * | 8/1999 | Palumbo | B65D 75/008 206/210 |
| 7,303,092 | B2 | 12/2007 | Sarbo et al. | |
| 7,717,620 | B2 | 5/2010 | Hebert et al. | |
| 2004/0124101 | A1 * | 7/2004 | Mitchell | B65D 83/0805 206/205 |
| 2006/0171971 | A1 | 8/2006 | Marsh et al. | |
| 2007/0221529 | A1 * | 9/2007 | Gioia-Smickle | B65D 81/24 206/494 |
| 2007/0284032 | A1 | 12/2007 | Stoppelmann | |
| 2010/0147724 | A1 * | 6/2010 | Mitra-Shah | B65D 75/5833 206/459.1 |
| 2011/0159061 | A1 | 6/2011 | Warren | |
| 2011/0268777 | A1 | 11/2011 | Marsh et al. | |
| 2012/0241333 | A1 | 9/2012 | Mueller et al. | |
| 2013/0126370 | A1 * | 5/2013 | DiLiberto | B65D 81/3272 206/219 |
| 2013/0199956 | A1 * | 8/2013 | Hunter | B65D 75/14 206/459.1 |
| 2014/0001196 | A1 | 1/2014 | Bushman et al. | |

OTHER PUBLICATIONS

LaxX: LaserSharp Flexible Packaging Equipment (http:www.lasx.com/laser-perforatingequipment.php) Sep. 30, 2010 (2 pages).

"Lasers assure the flow and flexibility of asceptic carton production" Ela Fruscione, Converting Magazine, Aug. 1999 (1 page).

"Microperforations for Fresh Cut Produce Packaging", Christopher Chow (www.precolaser.com), date unknown (6 pages).

"Laser Processing—It's part of the 'package'", Christopher Chow, Industrial Laser Solutions for Manufacturing, Feb. 2002 (3 pages).

$CO_2$ Lasers for Flexible Food Packaging—Converting Applications Need Reliable Lasers for Highest Throughput, William R. Dinauer and Frank Gaebler, www.laser-journal.de, Jan. 2008 (2 pages).

"Improvements to Laser Processing of Thin Polymer Films—Using Non-Standard Novel Laser Wavelengths", Tony Hoult and Bill Dinauer, Source and date unknown (5 pages).

"Cutting, Perforating,and Scoring Flexible Film for the Packaging Industry 'Sealed-Off' $CO_2$—Lasers Replace Mechanical Tooling", authors known, Euro Laser, Jun. 2008 (3 pages).

PCT International Search Report, mailed Jun. 1, 2015 (10 pages).

* cited by examiner

PACKAGE OF WET WIPES WITH EASY OPENABILITY, IMPROVED MOISTURE RETENTION AND MANUFACTURING EFFICIENCY

CROSS REFERENCE TO RELATED APPLICATION

This application claims the benefit of U.S. Provisional Application No. 61/955,980, filed Mar. 20, 2014, the substance of which is incorporated herein by reference.

BACKGROUND OF THE INVENTION

Wet wipes are currently sold for a variety of applications, including for use in personal cleansing in circumstances where soap, water, cloths, towels and a sink or washtub facility are unavailable or inconvenient.

Wet wipes as packaged and sold typically comprise a stack of individually cut sheets, or a continuous folded stack or roll of material having perforations dividing the material into lengths that may be torn away at the perforations as individual sheets. The material of which the sheets are formed may be a nonwoven material formed of polymeric or natural fibers, or a combination thereof. The material is typically highly porous and capable of absorbing and holding a substantial fraction of its weight, or more, of an aqueous lotion. The stack or roll may be moistened or even saturated with the aqueous lotion. The aqueous lotion may be a solution or an emulsion, or a combination thereof, and may contain one or more cleansing agents, skin care agents, preservatives (antibacterial agents) and perfumes. As such, the wipes may constitute a convenient and pleasant product useful for a variety of personal cleansing applications, such as hand wipes, child wipes, baby wipes, etc.

In order prevent the water portion of the lotion from evaporating from the wipes stack or roll after manufacture and packaging, it is necessary to package the moistened or saturated stack in a container that substantially retains the moisture content over the expected time between manufacture and use of the product. This is currently done in a variety of ways.

One way in which wet wipes are packaged is within a flow-wrap film package. A polymer film having a suitably low water vapor transmission rate is selected and used to form stock package material. Wet wipes stacks are formed and conveyed to a flow wrapping machine, which wraps the stock package material about each stack and forms seams in the material to join it to itself and seal it about the stack, thereby forming a moisture-retaining package of wet wipes that is sufficient to retain the moisture content from the time of manufacture to the time of purchase.

More is needed, however. Since a consumer will not ordinarily use the entire stack of wet wipes at one time, it may be desirable to provide some form of recloseable opening in the package, which allows the consumer to open the package easily and relatively non-destructively, withdraw wet wipes individually, and reclose the package. To retain the moisture in the remaining supply of wipes, it is desirable that the reclosure mechanism provide a sufficient barrier to moisture loss when properly closed.

Currently some flow-wrap wipes packages are sold with rigid plastic recloseable fitments. The fitment includes a ring portion that is adhered substantially about its perimeter to a face of the package, and a recloseable lid portion hingedly connected to the ring portion. The lid and ring portions may have cooperating features designed to retard moisture transmission between their respective contacting edges or surfaces, when in a closed configuration.

On the package face within the ring portion of the fitment, the package film may have therein a perforated outline of a tearaway portion. The outline is a series of perforations through the film that outline a shape, usually a closed shape. Because the perforations through the film may allow moisture to escape and the fitment may not be sufficiently effective to retard moisture loss over the time between manufacturing and application of a fitment lid covering the perforations, or manufacturing and purchase, an adhesive-backed sticker of sufficient size to cover all of the perforations may be applied over the film within the ring portion. When the consumer wishes to open the package, he or she may open the fitment lid and peel away the sticker. If the perforations, the shape, the sticker material and the adhesive are suitably selected and configured, the adhesive on the sticker will cause the underlying film within the perforated outline to remain adhered to the sticker, tear along the perforations, and pull away with the sticker, leaving an opening into the package in the shape of the perforated outline. The wipes may then be accessed and withdrawn through the opening. Following that, the consumer may reclose the lid, and the package may thereby retain moisture sufficiently during the time it takes for all of the wipes to be consumed.

It will be appreciated from the foregoing that the requirement for use of an adhesive sticker adds processing steps and cost to the wet wipes package. Therefore, an alternative way to provide a wipes package that effectively retains moisture between the time of manufacture and the time of opening by the consumer, while providing an easy opening feature and recloseable feature that sufficiently retains moisture during the time between package opening it takes for all of the wipes to be consumed, would be advantageous.

DETAILED DESCRIPTION OF THE INVENTION

As used herein, the term "z-direction" means orthogonal to an x-y plane defined by a surface of a film or portion thereof when laid out flat.

Figure 1:
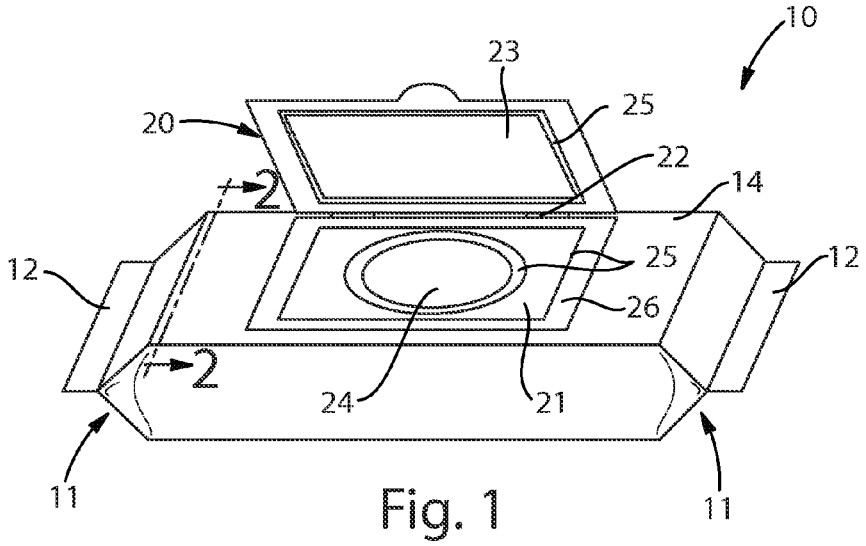
FIG. 1 is a perspective view of a package of wet wipes.
Figure 2:
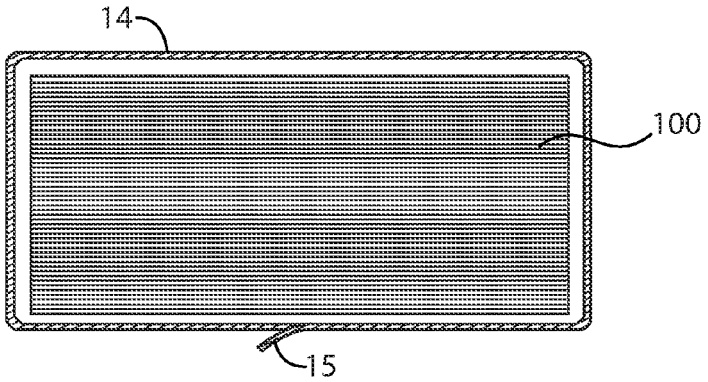
FIG. 2 is a cross-section of the package of FIG. 1, taken through line 2-2 shown in FIG. 1.
Figure 3:
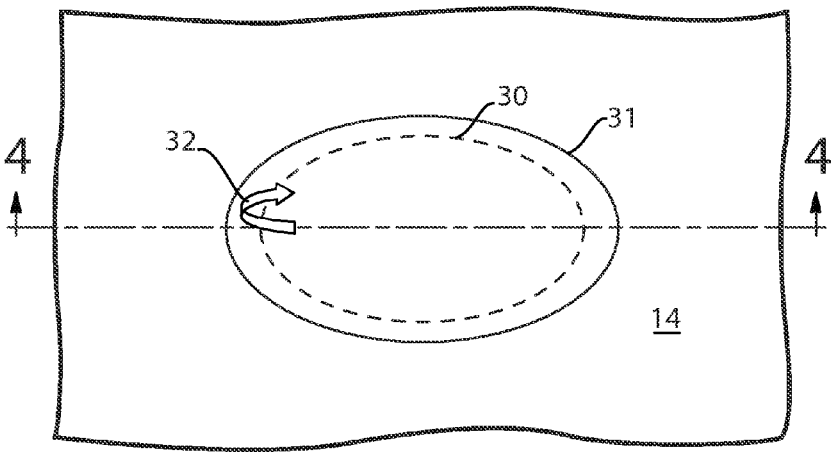
FIG. 3 is a plan view of a portion of a wipes package face with an outline of perforations forming an access opening, covered by a sticker.
Figure 4:
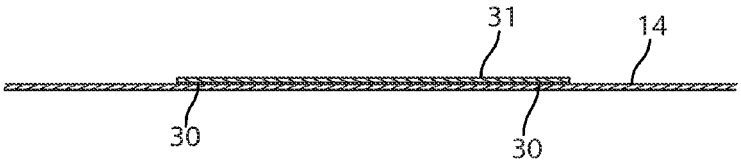
FIG. 4 is a cross section of the portion of the wipes package face of FIG. 3, taken through line 4-4 shown in FIG. 3.

FIGS. 1 and 2 depict a wet wipes package 10. Wet wipes package 10 may contain a stacked supply of wipes 100 formed of a suitable substrate of nonwoven web material, moistened or saturated with an aqueous lotion. Various non-limiting examples of aqueous wet wipes lotions are described in, for example, U.S. patent application Ser. Nos. 12/771,391; 12/974,731; and 11/048,446. The lotion may contain more than 80%, more than 85%, more than 90%, or even more than 95% by weight water. The wipes may be moistened with the lotion to minimum of 250%, or more preferably 300%, ratio of the weight of the lotion added to the weight of dry wipes substrate. For purposes of avoidance of unnecessary lotion usage and cost control it may be desired that the lotion load be limited to 600%, more preferably 550%, or even more preferably 500%, ratio of the weight of the lotion added to the weight of dry wipes substrate before addition of lotion.

Package 10 may be formed of a film that is flow-wrapped about the stack of wet wipes. The selected film material may be unwound from a stock roll and passed in a longitudinal/machine direction into a flow-wrap machine, along with individual wipes stacks. The flow-wrap machine may be configured so as to wrap the film stock longitudinally about each incoming stack, join the film along its longitudinal edges to form a sealed fin seam 15 and a sleeve-like structure about the stack, tuck the film at the ends to form tucks 11, and then crimp, seal and cut the film between each stack, forming individual packages 10 of wipes having end seams 12.

Package 10 may also be provided with a relatively rigid recloseable fitment 20. Fitment 20 may have a ring portion 21 and a lid 23, connected to the ring portion 21 by a hinge 22. Ring portion 22 may have an opening 24 therethrough to provide access into the package, surrounded by an escutcheon portion 26 that is adhered substantially along and about its perimeter to the film on an upper face 14 of the package 10 so as to provide a substantial moisture seal between the escutcheon and the film. Lid 23 may have an open position and a closed position. One or both of lid 23 and ring portion 21 may be provided with lip, rim, groove, gasket etc. cooperating sealing features 25 such that, when the lid is in the closed position, the cooperating sealing features 25 of lid 23 and/or ring portion 21 are in close proximity or effective contact with the other of lid 23 and/or ring portion 21 about the perimeter of the lid, so as to retard the passage of moisture between the lid 23 and the ring portion 21. One example may be a gasket (not specifically shown) formed of a material that is relatively softer than the material forming the fitment may be provided about the opening 24 and disposed on either the lid 23 or ring portion 24, to improve the moisture passage retarding function. The fitment including the ring portion 21, hinge 22 and lid 23 may be formed of a polymer such as a polyolefin, for example, polyethylene.

Figure 5:
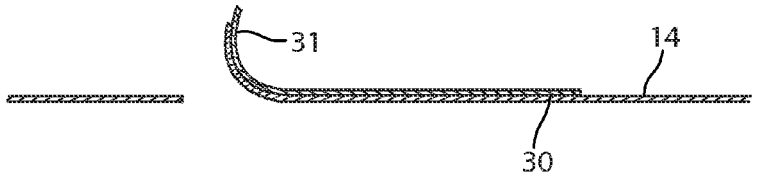
FIG. 5 is a view of the cross section of FIG. 4, but shown with one end of the sticker and a portion of package film lifted up.

Referring to FIGS. 1-4, within opening 24 of the fitment, some current wet wipes packages are provided with perforations 30 which outline a closed shape of an access hole through the film on a package upper face 14. The perforations 30 are typically formed by a perforating die, and typically completely penetrate the film. Accordingly, it is often deemed desirable to apply an adhesive-backed sticker 31 to the face 14, of sufficient size to cover all of the perforations 30 and thereby obstruct the passage of moisture therethrough. If the perforations, the shape, and the sticker and adhesive materials are selected and configured appropriately, the configuration will enable a consumer to peel the sticker away from the package face as suggested in FIG. 5, and the portion of the film within the outline of perforations will remain adhered to the sticker and relatively neatly tear away at the perforations, to leave behind an access hole through the film, within the opening 24 in the ring portion 21 of the fitment 20. A removal indicium 32 or other informational device may be included, e.g., on the sticker or on the film proximate or adjacent the sticker or the outline, to inform the consumer to peel away the sticker to create an access opening into the package, as depicted in FIG. 5. The sticker protects against moisture loss through the perforations 30 between the time of manufacture and the time of package opening, and the recloseable fitment protects against moisture loss through the access hole between the time of package opening and the time all of the wipes in the package are consumed. It will be appreciated, however, that providing and applying sticker 31 to the package adds process steps, material costs, equipment cost to the manufacturing line, and thus, cost to the product.

As an alternative to perforating the film and providing an overlying adhesive sticker, a relatively easily-created access hole may be defined by laser-scoring on a face of the film. Laser scoring may be performed using a laser light source, which may be selected by light frequency and power to penetrate the material of the film to a desired depth. Under certain circumstances, a laser may be selected and/or adjusted to score through one type of material without substantially scoring through another. Accordingly, a film having two or more layers may be selected to form package 10, and a laser light source may be selected and/or adjusted so as to be suitable to score substantially through only one of the layers. Suitable laser scoring equipment is available, for example, from LasX Industries, Inc., St. Paul, Minn. Despite the need presented for an alternative to use of a sticker as described above, to reduce costs, it is believed that, prior to the present disclosure, it has not been proposed to employ laser scoring to outline an access opening for a wipes package as described herein.

Figure 6:
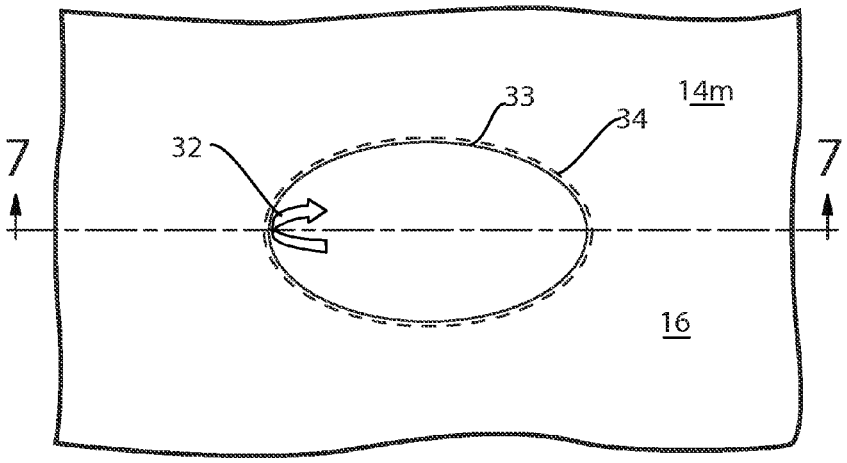
FIG. 6 is a plan view of a portion of a wipes package face with a scored groove forming an outline of an access opening.
Figure 7:
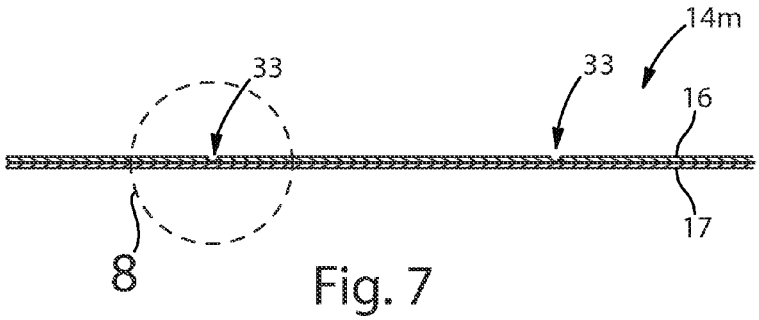
FIG. 7 is a cross section of the portion of the wipes package face of FIG. 6, taken through line 7-7 shown in FIG. 6.
Figure 8:
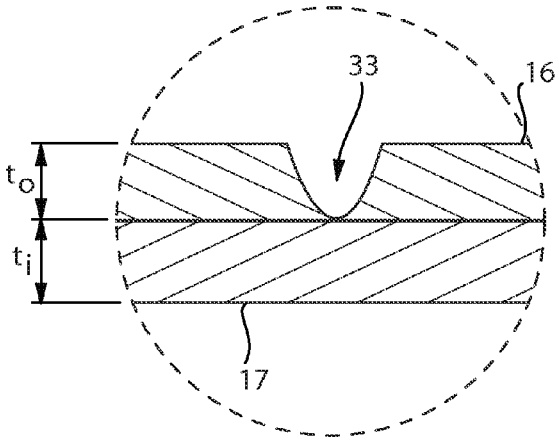
FIG. 8 is an enlarged view of a portion of the cross section shown circled in FIG. 7.

Referring to FIGS. 6-8, a multi-layer film **14*m* may be selected for use to form a package 10 with a laser-scored opening. The multi-layer film 14*m* may have, for example, an outer layer 16 formed of a first polymer and an inner layer 17 formed of a second polymer. (As used herein, the terms "outer layer" and "inner layer" refer to the positioning of the layer relative the interior and the exterior of the finished package; thus, the "inner layer" faces the contained product, and the "outer layer" faces outward and is visible to the consumer.) If flow-wrapping machinery forms a longitudinal fin seam 15 and/or end seams 12** that join the film stock to itself by applying heat that causes the film to weld or fuse to itself, it may be desirable that the inner layer be formed of a polymer that has a lower melting temperature than the polymer used to form the outer layer. This enables heat energy to be applied to a degree sufficient to heat the inner layer and cause it to weld or fuse to itself, but not sufficient to cause undesired melting and deformation of the outer layer. The outer and inner layers may be co-formed (such as by coextrusion), or in another example, may be separately formed and then laminated together following their formation, by use of a suitable laminating adhesive. In this latter example, an advantage provided is that one of the layers may be printed on one side before lamination. Following that, the printed side may be faced inward (facing the other layer(s)) during—lamination, such that it is protected by the other layer(s) from abrasion and wear in the finished film product, thereby preserving the integrity of the printed images, graphics, verbal content, etc.

Still referring to FIGS. 6-8, the outer layer may be scored by laser to form a scored groove 33 forming an outline of an access opening that may then be created in the film by tearing along the scored groove. The laser light source may be selected and adjusted so as to score the outer layer 16 without substantially scoring or penetrating the inner layer 17. This leaves the inner layer 17 at least partially intact to serve as a moisture barrier to retard the loss of water from the package through the scored access opening outline, but it may be exposed to outside air in the grooved area. Accordingly, the inner layer should have a water vapor transmission rate suitably selected so as not to allow moisture to escape at the scored area to an undesirable extent.

The shape characteristics of the outline formed by the scored groove 33 may be deemed important. It may be preferable that the shape be selected from the group consisting of circle, oval, ovaloid, ellipse, egg-shape, rounded rectangle (rectangle with rounded corners), or any shape that lacks sharp corners. Alternatively, it may be preferable that the scored groove 33 include few or no sharp turns or corners, which can have the effect of localizing stresses that can promote tear propagation that strays beyond or outside of the groove. Thus, it may be preferred that the scored groove 33 does not include any curve having a radius less than 5 mm along any portion thereof. A circular, oval or elliptical shape may be more preferred, and an oval or elliptical shape most preferred. Additionally, it may be preferred that the selected shape have an aspect ratio of greatest dimension to smallest dimension not exceeding 4.0, more preferably not exceeding 3.0, more preferably not exceeding 2.5, and still more preferably not exceeding 2.0. This may help ensure that any curves in the scored outline are not so sharp as to concentrate tearing stresses to an extent therealong that promotes propagation of tears that stray beyond or outside the scored groove 33. One or more of these characteristics may be important to reduce the possibility that a tear, initiated by the consumer attempting to create the opening, will propagate outside or beyond the scored groove, resulting in a misshapen, unsightly opening, compromising the moisture-retaining functionality of the package, or simply frustrating the consumer.

Referring to FIG. 6, it may be desired to include a printed opening outline indicium 34 on the upper face, about the scored groove 33. Such an indicium may be simply a printed outline of the shape of the scored groove disposed to the inside or to the outside thereof (as shown in FIG. 6), or even substantially co-located with the scored groove, serving to indicate to the consumer that the scored groove is present, or indicating its location. A printed removal indicium 32 as described above also may be included. These printed indicia may be printed on the inner surface of outer layer 16 as described above for other printed graphics, images and information, or may be printed on the outer surface of the film.

For reasons in addition to effects on moisture barrier capabilities, thickness of the inner layer 17 might be controlled so that it is not so thin as to permit unintended tearing thereof during handling of the package, prior to intentional opening by the consumer after purchase. In many current processes for manufacturing and handling flow-wrap packages of the nature of wet wipes packages, the packages may be dropped and shifted by equipment in various and random orientations before being packaged in orderly fashion in larger protective containers. The film along the scoring should be sufficiently strong so as not to permit unintended tearing during such handling. Thus, for example, it may be desired that the thickness of the film layer $t_i$ be not less than 35 μm, more preferably not less than 38 μm, more preferably not less than 43 μm, and still more preferably not less than 48 μm, where the film layer having thickness $t_i$ includes polyethylene.

At the same time, in order for the scored groove 33 to provide an access opening outline that is acceptably convenient and easy for the consumer to tear along to create an opening, it may be desired that the thickness $t_i$ of the inner layer be not greater than 60 μm, more preferably not greater than 55 μm, and even more preferably not greater than 52 μm, where the film layer having thickness $t_i$ includes polyethylene.

As noted, the inner layer may be formed of polyethylene or a blend of resins including polyethylene at a weight content greater than 50%.

In order to provide supplemental mechanical strength about the opening outline, a rigid plastic fitment such as described above may be adhered to the film about the scored access opening outline prior to substantial post-manufacturing handling as described above, and relied upon to provide added moisture-retaining integrity to the scored access opening outline, and the package. For example, the fitment may be adhered to the film about the scored access opening outline prior to packaging of a plurality of wet wipes packages in a larger shipping box or other container, or even prior to the time the individual packages exit the processing line that includes the flow-wrapping equipment and process, e.g., prior to the time the individual packages experience shocks from being dropped. In one particular example, the fitment may be applied and adhered to the package immediately following formation of the package by the flow-wrapping equipment.

Additionally, it may be desired that the ratio of the thickness $t_o$ of the outer layer to the thickness $t_i$ of the inner layer is not less than 0.11, more preferably not less than 0.14, more preferably not less than 0.16, more preferably not less than 0.19, and still more preferably not less than 0.22. If the outer layer is insufficiently thick as compared with the inner layer, the scored groove 33 through the outer layer may be of insufficient relative depth and the outer layer of insufficient relative thickness, to guide tear propagation along, and confine it to, the access opening outline as defined by the groove, and thereby guide neat tearing of the inner layer along the outline.

A suitable multilayer film **14*m*** may be formed of one or more polyolefins, such as polypropylene or a blend of resins containing a predominate weight percentage of polypropylene for a first layer; and polyethylene or a blend of resins containing a predominant weight percentage of polyethylene for a second layer.

In a non-limiting example, a layer formed predominately of polypropylene having a first relatively higher melting temperature, and a layer formed of predominately of polyethylene having a second relatively lower melting temperature, may be used to form the outer and inner layers, respectively. A predominately polyethylene layer having a thickness of not less than 35 μm, more preferably not less than 38 μm, more preferably not less than 43 μm, and still more preferably not less than 48 μm, may form the inner layer and may be sufficient to satisfy the requirement for water vapor transmission rate in a packaged with a laser-scored opening outline. In a non-limiting example, the outer layer may be a predominately polypropylene layer having a thickness $t_o$ of not less than 10 μm, more preferably not less than 15 μm, and still more preferably not less than 20 μm.

From the foregoing, it may be appreciated that use of laser scoring to create an access opening in a multilayer polymer film package may have application beyond the context of packaging wet wipes. It may be useful in any application where ease of opening but retention of moisture within the package is desired. It may also be useful in any application where ease of opening but preventing entry of moisture into the package is desired (e.g., in high-humidity environments). It may also be useful in any application where ease of opening but preventing escape of vapors of volatile product ingredients (e.g., solvents or perfumes) is desired.

Thus, for example, a multi-layer polymer film package with a laser-scored opening may be useful for packaging, for example, dry (powdered or granulated) laundry detergents; dishwasher detergents; household dusters and wipes; disposable diapers, training pants and incontinence pants; feminine hygiene pads and tampons; cosmetic, cleansing and/or perfume wipes; and dry or moist pet foods. Any such packages may be imparted with any of the features described herein for a wet wipes package, and similarly manufactured. It will be recognized that selection of film layer(s) polymer composition(s) and overall film/layer z-direction thickness(es), shape of laser-scored opening outline, and laser scoring depth, will be necessary to strike a balance between ease of opening, ease of access to product, vapor retention and/or exclusion, and package integrity during shipping and handling, to make the package suitable for the particular application.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description are, in relevant part, incorporated herein by reference; the citation of any document is not to be construed as an admission that it is prior art with respect to the claims. To the extent that any meaning or definition of a term in this document conflicts with any meaning or definition of the same term in a document incorporated by reference, the meaning or definition assigned to that term in this document shall govern.

While particular embodiments have been illustrated and described, it would be obvious to those skilled in the art that various other changes and modifications can be made without departing from the spirit and scope of the invention. It is therefore intended to cover in the appended claims all such changes and modifications that are within the spirit and scope of this invention.

The invention claimed is:

1. A package containing a stack of wet wipes comprising a plurality of individual sheets of substrate material moistened with lotion, the lotion having a water content of at least 80 percent by weight, the package comprising:

a polymeric film wrap, wrapped about the stack of wipes and bonded to itself at a plurality of seams, the film wrap comprising:

a laminate having an inner layer of a first polymer and an outer layer of a second polymer; and a surface bearing scoring along a path defining a substantially closed shape, the scoring being substantially continuous and at least partially penetrating the outer layer in the z-direction, and not entirely penetrating the inner layer in the z-direction.

2. The package of claim 1 further comprising a fitment comprising a ring portion adhered to the surface about, and circumscribing, the closed shape, the ring portion defining an opening about the closed shape, and a lid portion hingedly connected to the ring portion and operable to open and close to cover the opening.

3. The package of claim 1 wherein the scoring has been effected by application of a beam of light produced by a laser light source.

4. The package of claim 1 wherein the first polymer comprises polyethylene and the second layer comprises polypropylene.

5. The package of claim 1 wherein the closed shape is selected from the group consisting of a circle, an oval, an ovaloid, an ellipse, and a rounded rectangle shape.

6. The package of claim 1 wherein the outer layer has a first z-direction thickness and the inner layer has a second z-direction thickness, and the ratio of the first thickness to the second thickness is not less than 0.11, more preferably not less than 0.14, more preferably not less than 0.16, more preferably not less than 0.19, and still more preferably not less than 0.22.

7. A method for producing a package containing a stack of wet wipes, comprising the steps of:

providing a stack of wipes comprising a plurality of individual sheets of substrate material;

impregnating the stack of wipes with an aqueous lotion;

providing a polymeric film wrap material comprising a laminate having an inner layer of a first polymer and an outer layer of a second polymer;

scoring the polymeric film wrap material by applying a beam of light produced by a laser light source to the film wrap, to at least partially penetrate the outer layer in the z-direction, but not entirely penetrate the inner layer in the z-direction, along a path defining a substantially closed shape;

wrapping the film wrap material about the stack of wipes with the inner layer facing the stack of the wipes and the outer layer facing away from the stack of wipes, and bonding the film wrap material to itself along a plurality of seams, to enclose and contain the stack of wipes; and adhering a ring portion of a fitment, the ring portion defining an opening, to a surface of the film wrap material, such that the opening circumscribes the closed shape;

wherein the aqueous lotion is provided to a load of at least 250% weight of lotion to weight of the stack of wipes before addition of lotion.

* * * * *